US005345651A

United States Patent [19]

Roberts

[11] Patent Number: 5,345,651

[45] Date of Patent: Sep. 13, 1994

[54] NOZZLE BRUSH ATTACHMENT FOR VACUUM CLEANERS

[76] Inventor: Jeffrey J. Roberts, 205 SW. Linden St., Ankeny, Iowa 50021

[21] Appl. No.: 60,801

[22] Filed: May 13, 1993

[51] Int. Cl.[5] ..... A47L 9/06
[52] U.S. Cl. ..... 15/397; 15/398
[58] Field of Search ..... 15/397, 398, 400

[56] References Cited

U.S. PATENT DOCUMENTS

| | | | |
|---|---|---|---|
| 925,646 | 6/1909 | Moorhead | 15/397 |
| 955,467 | 4/1910 | Moorhead | 15/397 X |
| 1,042,713 | 10/1912 | Moorhead | 15/397 X |
| 1,982,345 | 11/1934 | Kirby | 15/397 X |
| 2,276,944 | 3/1942 | Dow | 15/397 |

FOREIGN PATENT DOCUMENTS

| | | | |
|---|---|---|---|
| 19765 | of 1908 | United Kingdom | 15/397 |

*Primary Examiner*—Chris K. Moore
*Attorney, Agent, or Firm*—Brian J. Laurenzo; Kent A. Herink; Brett J. Trout

[57] ABSTRACT

A nozzle assembly for a vacuum cleaner having a brush (10) of uniform cross section about which the nozzle assembly is constructed around. A plurality of flexible tubes (12) are inserted within brush (10). The bristles of brush (10) extend beyond the ends of tubes (12), communicating with tubes (12) during a cleaning process. A clamp (14) secures tubes (12) within the bristles at evenly spaced locations. Tubes (12) create suction within brush (10) and provide airflow back to the vacuum cleaner. An attachment adapter (16) is formed around the perimeter of clamp (14) and enables the nozzle assembly to be connected to the vacuum cleaner.

5 Claims, 2 Drawing Sheets

NOZZLE BRUSH ATTACHMENT FOR VACUUM CLEANERS

BACKGROUND—FIELD OF INVENTION

Computer keyboards regularly become soiled and the cleanliness of the keys is important for the longevity of the keyboard. Manual cleaning with cloth and solvent is cumbersome and time consuming.

Minute vacuum nozzles with brush bristles on the end, commonly advertised to be used specifically on keyboards, may be effective for loose dust and unlodged particles, but are ineffective in scouring away embedded grime. These minute nozzles are also incapable of being used with solvents. Vacuum nozzles with brush bristles on the circular perimeter of the nozzle, currently a standard attachment for vacuums, are typically too large for small, minute applications and don't provide a desired pinpoint airflow. The vacuum attachment currently being manufactured by Idea Works, Indian Wells, Calif., called the "Wacky Vac", suffers in its scouring ability due to nonrigid and unsupported plural nozzles. These flexible plural nozzles, each with a few bristles at the end, provide minimal, if any scrubbing ability. It also is incapable of being used with solvents.

U.S. Pat. No. 4,279,095 to Aason (1980) is very similar to my patent being applied for. To be used with a vacuum source, it has an array of pliable fingers communicating with plural, flexible tubes to remove fleas from pets. But the pliable fingers and the limited depth it can reach would make it useless in the above application. Many patents comprise plural nozzles, many of which are to be used on carpet. Many other patents use vacuum nozzles in conjunction with various brush designs, but other than what is mentioned above, I have been unable to unsurface an invention that combines these two concepts to work in communication with each other, effectively satisfying the previously mentioned need.

OBJECTS AND ADVANTAGES

Accordingly, several objects and advantages of the invention being applied for are:

(a) to provide the ability to scour and remove grime and debris from hard to reach places where normal liquid washdown procedures are not desired or prohibitive;

(b) to provide speed and ease in cleaning small areas that are difficult and time consuming to access;

(c) to provide more thorough and pinpoint cleaning of items with grooved or notched surfaces, intricate corners, or repetitive features;

(d) to provide a way of using dissolving solvent effectively and removing the solvent without the solvent seeping into areas that are susceptible to damage from the solvent;

(e) to provide a device that may be used on multiple applications, such as automobile dashboards, electronic equipment, or any other item with small, complex forms that become soiled;

(f) to provide a way to satisfy the previously mentioned needs with a device that contains relatively few parts, a small amount of material, no moving parts, and is easily maintained.

Further objects and advantages will become apparent from a consideration of the ensuing description and drawings.

DRAWING FIGURES

REFERENCE NUMERALS IN DRAWINGS

10 brush
12 tubes
14 clamp
16 attachment adapter

DESCRIPTION—FIGS. 1 to 7

Figure 1A:
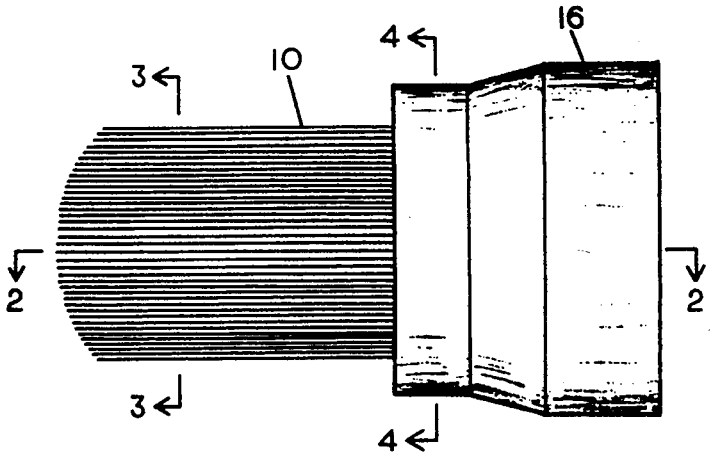
FIG. 1A is a side view of a nozzle assembly.
Figure 1B:
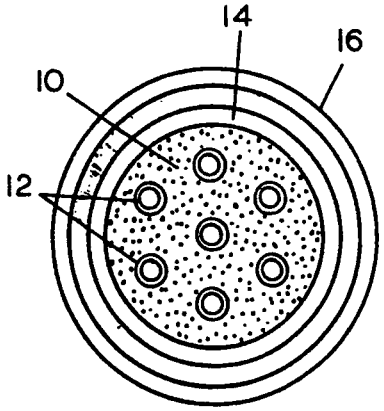
FIG. 1B is an end view showing the end that attaches to a vacuum source.
Figure 1C:
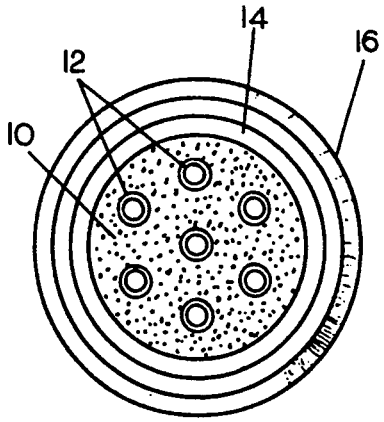
FIG. 1C is an end view showing the other end that does the cleaning.

A typical embodiment of the nozzle assembly of the invention is illustrated in FIGS. 1A, 1B, and 1C. The nozzle has a brush 10 of uniform cross section comprising soft, durable bristles. Brush 10 is the foundation which the nozzle assembly is formed around. In the preferred embodiment, the bristles of brush 10 are of similar quality to those used for painting, such as Bristlene TM manufactured by The Newell Group of Milwaukee, Wis. Bristles of brush 10 may also be composed of goat hair, horse hair, or synthetic materials of varying diameters such as polystyrene, nylon, polyethylene, or polypropylene. Brush 10 typically has a cylindrical form with the working end being rounded or beveled. Brush 10 is roughly 28 mm to 34 mm in diameter and 45 mm to 55 mm in exposed length.

Figure 2:
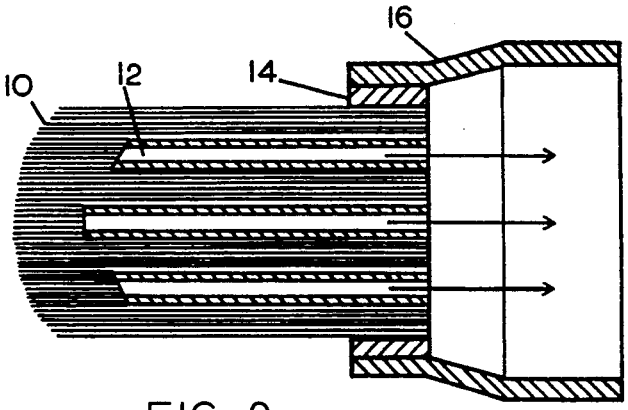
FIG. 2 is a section view showing a lengthwise cut through nozzle assembly.
Figure 3:
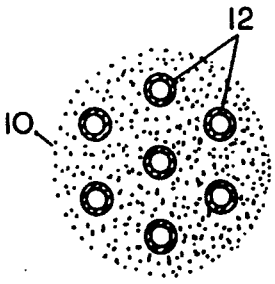
FIG. 3 is a section view showing a cut through the middle of a brush.

FIGS. 2 and 3 show a plurality of tubes 12 within brush 10 at precise spaced locations. Tubes are open at both ends. Brush 10 extends roughly 10 mm to 15 mm beyond the end of tubes. Tubes are composed of material such as nylon or polyethylene that is both flexible and strong. The thinnest possible wall thickness of tubes is desired to provide internal tube area for increased airflow while allowing more area for bristles to occupy. The preferred embodiment contains approximately 6 to 8 tubes within brush 10.

Figure 4:
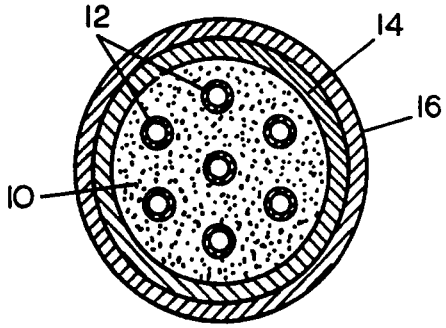
FIG. 4 is a section view through the connection of a clamp and attachment adapter.

FIG. 4 shows a clamp 14 around brush 10. After tubes 12 are aligned in evenly spaced locations within brush 10, clamp is tightened around the base of brush, firmly securing tubes within brush in an efficient arrangement. Clamp 14 is typically made of metal and is similar in design to those used on common paint brushes.

FIGS. 2 and 4 show an attachment adapter 16 that is formed around the exterior of clamp 14. Attachment adapter is typically made of plastic. Attachment adapter will vary in size and shape depending on the size and shape of brush 10 and the size and shape of a vacuum source to such as a suction hose for a motorized vacuum which the nozzle assembly will be attached. Attachment adapter 16 adheres to clamp 14 by applying heat or adhesive.

Figure 5:
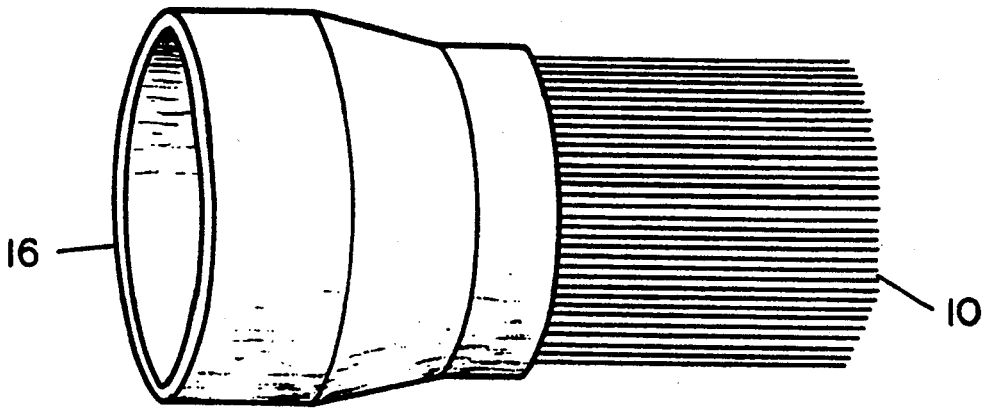
FIGS. 5 and 6 are horizontal isometric views of the nozzle assembly.
Figure 6:
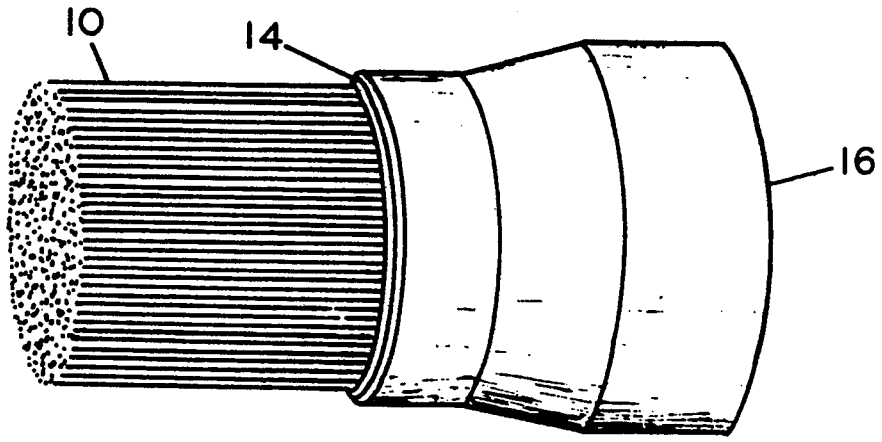
Figure 7:
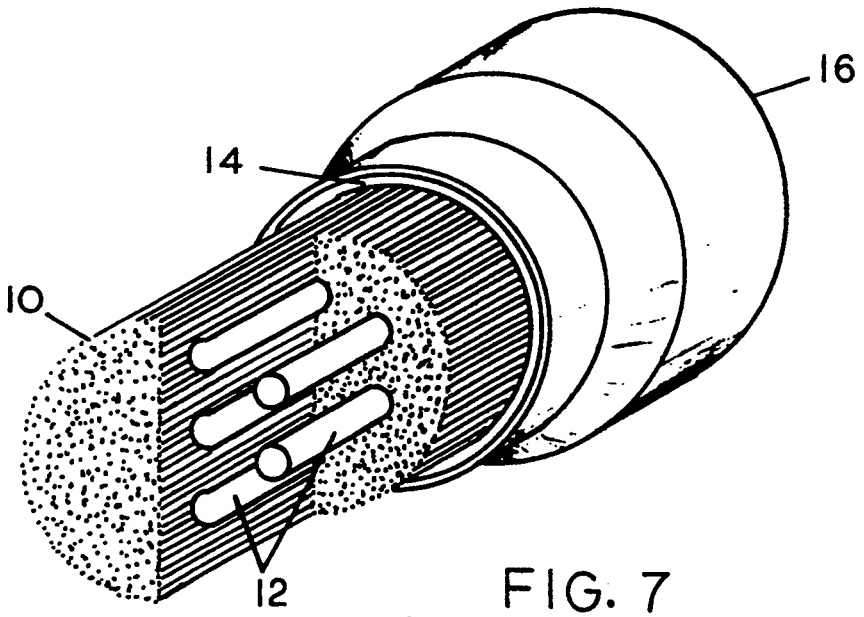
FIG. 7 is an oblique view of the nozzle assembly with part of brush bristles cut away to expose tubes.

An additional embodiment is shown in FIGS. 5, 6, and 7. This embodiment is the same as the previous embodiment except the end of brush 10 is flat.

From the description above, a number of advantages of my nozzle assembly become evident:

(a) the flexibility of the working end of brush 10 enables the bristles to reach minute or hard to get at places that are soiled.

(b) the proximity of the end of tubes 12 to the end of the bristles allow solvent and unlodged debris to be efficiently removed from a surface being cleaned.

(c) the uniformity of the bristles between tubes allow for effective scrubbing of surfaces, especially when a solvent is applied to the surface being cleaned.

(d) the nozzle assembly is composed of a minimum amount of parts and materials.

(e) a brushing motion applied by a user on the surface being cleaned provides speedy and effective cleaning of areas that would otherwise be difficult and time consuming to clean.

OPERATIONS—FIGS. 1, 2, 5, 6, 7

The manner of using the nozzle assembly is similar to automobile parts cleaning stations that have recirculating solvent flowing from an oriface and a wire brush to scrub grease from parts. The nozzle assembly allows the combined use of liquid and brushing to clean items.

Attachment adapter 16 enables the nozzle assembly to be connected to a vacuum source. A desirable solvent is commonly applied to the surface being cleaned. Holding attachment adapter, the user induces a brushing motion with the nozzle on the surface being cleaned, wherein brush 10 dislodges and scrubs away unwanted dust, soil, or grime from the surface. Plural tubes 12 (FIGS. 2 and 7) within brush 10 provide suction within the bristles. The combination of the flexing motion of brush 10 and the suction within brush removes the unwanted debris from the bristles of brush 10, through tubes 12, and back to the vacuum source (FIG. 2).

Clamp 14 keeps tubes 12 secured within brush 10 at spaced locations during the cleaning process. The nozzle assembly provides best results when brush 10 is frequently cleaned.

SUMMARY, RAMIFICATIONS, AND SCOPE

Accordingly, the reader will see that the nozzle assembly of this invention can be used to clean intricate and complex areas with the use of solvent and a brush. In addition, the nozzle can be used in applications that require the solvent and/or debris to be remotely removed to avoid coming in contact with susceptible adjoining components, causing potential damage. Furthermore, the nozzle assembly has the additional advantages in that the composition and uniformity of the bristles enable the thorough cleaning of delicate surfaces;

it can be used in a wide variety of applications;

it is easy to use and other than periodic cleaning, requires no maintenance to remain effective; and it provides quick and effective cleaning of areas that would otherwise be extremely difficult and time consuming to clean.

While the description above contains many specifications, these should not be construed as limiting the scope of the invention but merely an exemplification of one preferred embodiment thereof. Many other variations are possible. For example, the brush may rotate via an electric motor or the attachment adapter may include a pivoting mechanism whereby the nozzle assembly could be rotated in relation to the vacuum source, etc.

Accordingly, the scope of the invention should be determined not by the embodiment illustrated, but by the appended claims and their legal equivalents.

I claim:

1. A nozzle assembly for attachment to a vacuum source, said vacuum source which creates a suction flow of air through vacuum openings, said nozzle assembly providing for the scouring and removal of dirt from tight, hard-to-reach places, said nozzle assembly comprising:

(a) a spaced array of open-ended tubes, said tubes parallel to one another axially, said tubes in flow communication with said vacuum source so as to provide suction;

(b) a brush element formed by a plurality of bristle members, said bristle members filling the space between said tubes;

(c) means for holding said bristles and tubes in a fixed relationship; and (d) means for flow connecting said nozzle assembly to said vacuum source.

2. The nozzle assembly of claim 1, wherein said tubes are of shorter length than said bristles.

3. The nozzle assembly of claim 1, wherein said tubes are comprised of flexible material.

4. The nozzle assembly of claim 1, wherein said tubes are of annular cross section.

5. The nozzle assembly of claim 1, wherein said brush is of a cylindrical shape.

* * * * *